US005183421A

United States Patent [19]

Yin

[11] Patent Number: 5,183,421

[45] Date of Patent: Feb. 2, 1993

[54] CONNECTOR CONTACT AND METHOD OF MANUFACTURE

[75] Inventor: Mercury Yin, Hsin Tien, Taiwan

[73] Assignee: Foxconn International, Inc., Sunnyvale, Calif.

[21] Appl. No.: 734,886

[22] Filed: Jul. 24, 1991

[51] Int. Cl.[5] ..... H01R 13/00

[52] U.S. Cl. ..... 439/857

[58] Field of Search ..... 439/851, 852, 856, 857, 439/861, 862

[56] References Cited

U.S. PATENT DOCUMENTS

| | | | |
|---|---|---|---|
| 3,836,947 | 9/1974 | Yeager | 439/852 |
| 3,850,500 | 11/1974 | Cobaugh et al. | 439/857 |
| 3,862,792 | 1/1975 | Jayne | 439/851 |

*Primary Examiner*—Joseph H. McGlynn
*Attorney, Agent, or Firm*—John J. Leavitt

[57] ABSTRACT

Presented is a socket contact structure (31) for electrical connectors (32), and a fabricating method utilizing a half-pitch contact spacing for the electrical connectors. The socket contact structure (31) includes a terminating section (34) formed at one end of the contact. A mating section (36), with a U-shaped intermediate portion (54) and a pair of spaced cantilever arms (55,56) extending therefrom, is formed from metal strip stock at the other end of the contact (31). The mating section (36) is stamped and formed from a first strip (41) having a first free end (41*a*) and a second free end (41*b*), with the first free end (41*a*) bent through about 180 degrees toward the second free end (41*b*) in a spaced overlapping relation. The first strip (41) is also bent through about 90 degrees with respect to the second strip (42) along a bend line (43) of the adjacent portion toward the second strip (42).

15 Claims, 4 Drawing Sheets

FIG. 1
(PRIOR ART)
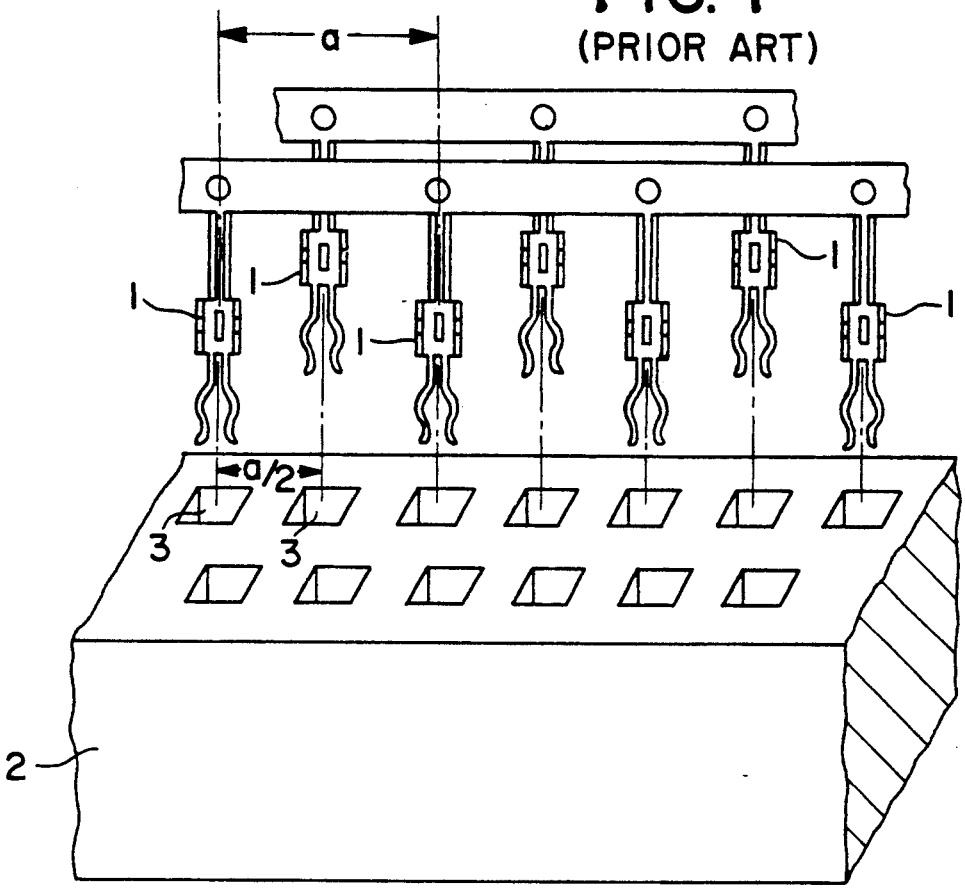
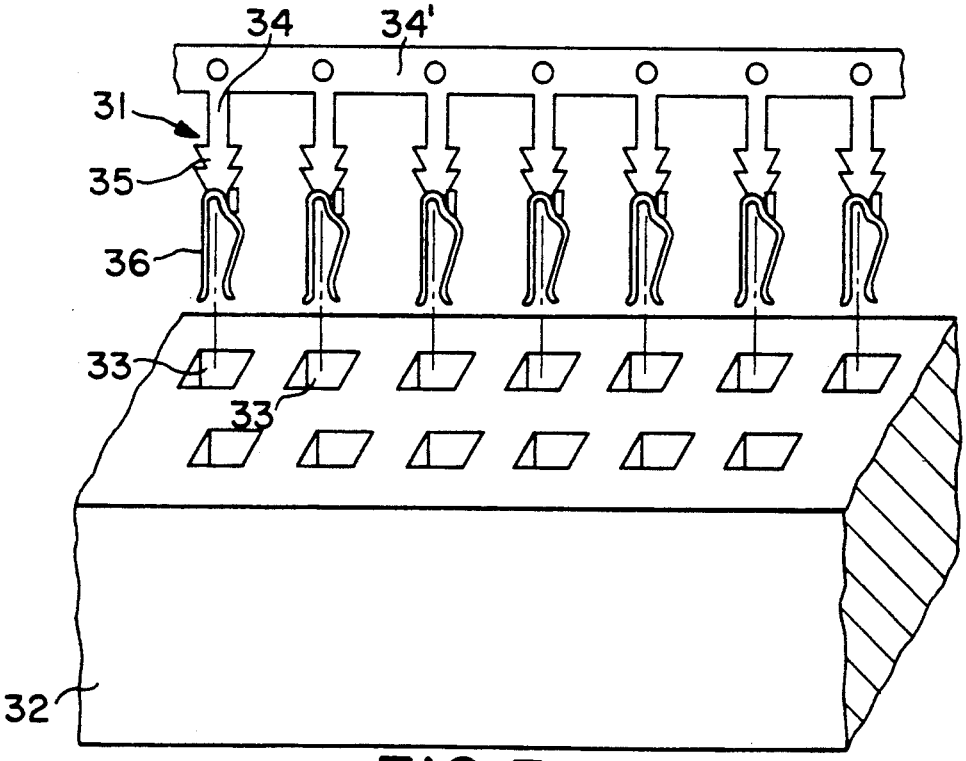
FIG. 3

CONNECTOR CONTACT AND METHOD OF MANUFACTURE

BACKGROUND OF THE INVENTION

1. Field of the Invention

The present invention relates to a socket contact for an electrical connector and a fabricating method therefor and, more particularly, to the structure of a half pitch contact for electrical connector and method of making the same.

2. Description of the Prior Art

In the generally recognized conventional manufacturing method of electrical connector contacts, the centerline spacing of the adjacent contacts must be one pitch such that sufficient material is reserved for the extent of the contact onto the strip stock due to the requirement of the contact design, which results in the arrangement of the contact in strip form is of full pitch centerline spacing pattern, conversely the terminal receiving passages of the insulator housing are in half pitch centerline spacing pattern. Obviously, the pattern of full pitch centerline spacing between the adjacent contacts of the prior art requires additional material, stampings, assembly procedures, product assembly time, overall cost to produce a connector.

FIG. 1 depicts an exploded perspective view of an electrical connector of the prior art with the contact 1 and insulator housing 2, enabling a detailed explanation of the prior art. As shown in FIG. 1, the insulator housing 2 is comprised of terminal receiving passages 3 to receive contact 1, and the centerline spacing "a/2" of the adjacent passages is in half pitch pattern while the centerline spacing "a" of the adjacent contacts 1 are in a full pitch pattern. In accordance with the full pitch centerline spacing of the adjacent contacts of the prior art, it requires a two step procedure to insert contact sets into each row of terminal receiving passages 3 of insulator housing 2. If the contact sets were manufactured in a pattern of half-pitch centerline spacing corresponding to the spacing of the terminal receiving passages 3 of insulator housing 2, it is obvious that manufacturing costs can be significantly reduced.

In practice, there are some restrictions which must be circumvented in order to manufacture the contact set in a half-pitch centerline spacing pattern. Manufacturing of known contacts with full pitch centerline spacing has an advantage in that excess material is available between the adjacent contacts on the contact set from which to form each contact. In light of this advantage, more latitude is provided in the design of various contact shapes since there is an excess of material to work with. But the cost to produce such connectors will increase due to material scrappage, additional assembly procedures and plating. The half-pitch design will reduce manufacturing cost for the inverse of the reasons above. Due to limited available material, a designer of contacts faces significant restriction in designing a half-pitch contact with similar electrical connection characteristics when compared to the full pitch contact.

One of the objects of this invention is to reduce the cost of manufacturing socket contacts. Another object is to overcome the restraint in practice of using half-pitch manufacturing techniques. A still further object is to develop a new socket contact structure. Yet another object is to provide a manufacturing method for electrical connector contacts which is cost-effective and with near-perfect electrical contact characteristic.

To illustrate the above mentioned objective, characteristic, and effect, the succeeding figures are cited to contrast the disadvantages of the generally recognized contact structure of electrical connector and the associated manufacturing method of the contact structure and fabricating technique of this invention.

The invention possesses other objects and features of advantage, some of which, with the foregoing, will be apparent from the following description and the drawings. It is to be understood however that the invention is not limited to the embodiments illustrated and described since they may be embodied in various forms within the scope of the appended claims.

SUMMARY OF THE INVENTION

In terms of broad inclusion the contact structure and method of producing it comprises forming a carrier strip of electrically conductive metal to provide a repeating half-pitch pattern of apertures and slits in the carrier strip that enable bending and forming successive portions into socket contacts adapted to receive a male contact member.

BRIEF DESCRIPTION OF THE DRAWINGS

FIG. 1 is an exploded perspective view of the generally recognized electrical connector contact and insulator housing of the prior art.

FIG. 3 is an exploded perspective view of a completed half-pitch connector contact and insulator housing according to this invention.

DESCRIPTION OF THE PREFERRED EMBODIMENTS

Figure 2A:
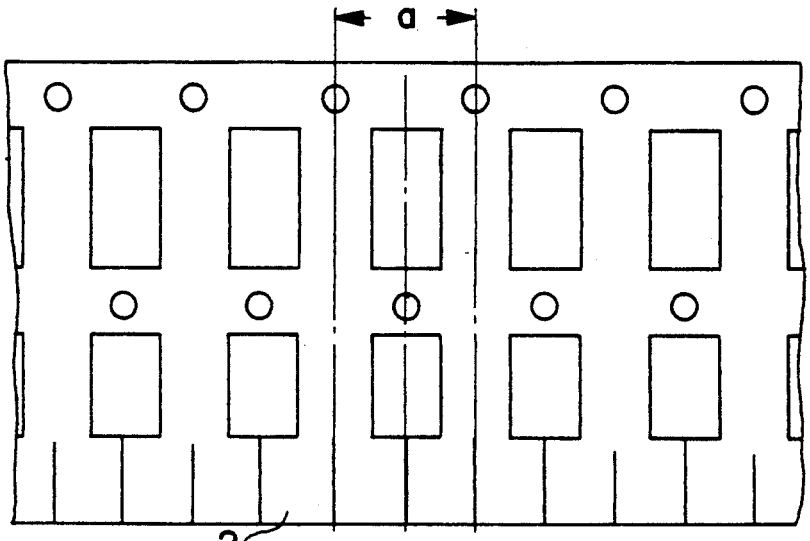
FIGS. 2A, 2B and 2C illustrate by comparison the excess material required in the manufacture of the generally recognized full pitch connector contact (FIG. 2A) as compared with the half-pitch contacts disclosed by my invention.
Figure 2B:
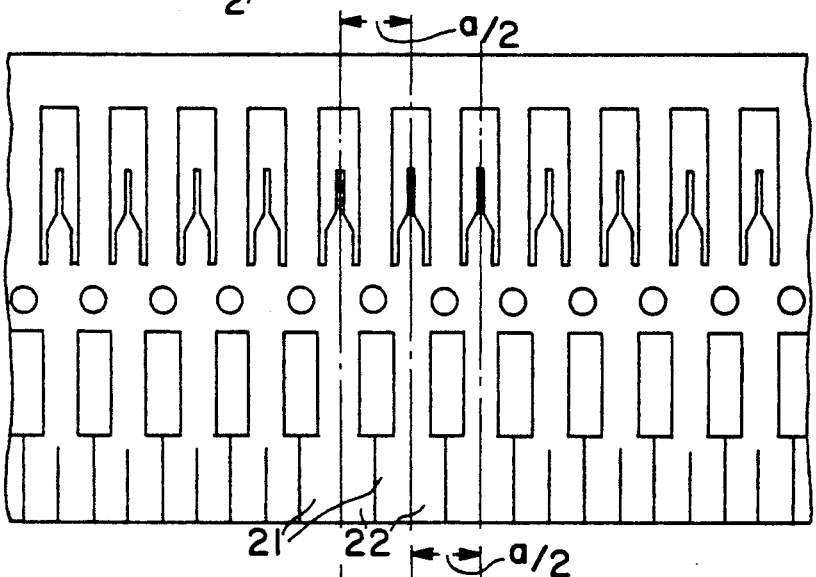
Figure 2C:
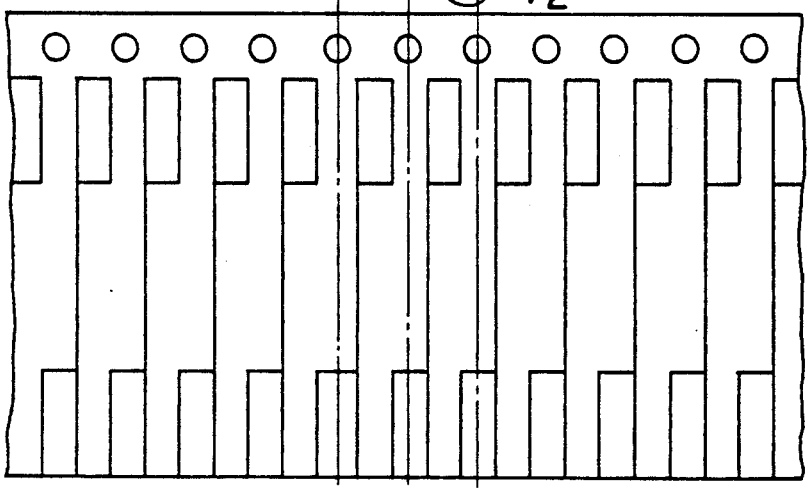

FIGS. 2A, 2B and 2C illustrate a comparison of the arrangement of full and half-pitch contacts on their respective carriers. FIG. 2A illustrates the array of the conventional full pitch contact of the prior art; FIG. 2B illustrates the array of one embodiment of a half-pitch contact; FIG. 2C illustrates the arrangement of a half-pitch contact in accordance with this invention. Referring to FIGS. 2B and 2C, it is apparent that the centerline spacing "a/2" of the adjacent contacts in the half-pitch contact set is one-half the spacing "a" of the full pitch contact sets. Accordingly, the material required using the full pitch carrier design of FIG. 2A is double that of the half-pitch layout of FIGS. 2B and 2C. The full pitch design allows multiple variation of the design to meet design criteria. The additional material when designing the full pitch socket connectors will result in additional material scrappage and additional plating which will increase cost to produce the contact. A comparison of the advantages and disadvantages of the full pitch layout to the half-pitch layout is as follows:

1. The material required for a contact formed in a full pitch layout is sufficient to form two contacts with half-pitch layout. In the mass production environment, the half-pitch layout obviously possesses a cost-effective advantage.

2. The centerline spacing of the terminal-receiving passages in the typical electrical connector insulator housing is a half-pitch pattern even a full pitch contact spacing is used, which requires two individual insertion procedure steps to insert full pitch contacts into each row of half-pitch terminal-receiving passages of an insulator housing as shown in FIG. 1, while only one insertion procedure step is required for contact sockets formed by a half-pitch layout to complete the same insertion operation as shown in FIG. 3. Accordingly, contacts having a half-pitch layout may require only half of the assembly time when compared to contacts having a full pitch layout.

3. When conveying a continuous carrier strip with a plurality of connector contacts through a plating bath using an automatic conveyor, a half-pitch layout carrier strip exhibits a time-saving advantage when compared to the full pitch layout carrier strip under the same electrical plating conditions and plating processes when plating a plurality of materials. In other words, in a plating environment of specific length of carrier and specific amount of time, it may be expected that more half-pitch contacts will pass through the plating bath than is the case with full pitch layout carrier, which results in the saving of plating time and plating cost.

Considering the significant economic effect, it is an advantage to design and produce a half-pitch contact which satisfies all design and performance parameters. The fact that available material surface area on the strip for each contact with half-pitch layout is half as much as that of full pitch layout, imposes a limitation of feasible design patterns as well as an obstacle to obtaining optimum physical features, especially the connection feature at the contact portion of the conventional connector contact of FIG. 1 whereby the cantilever arms are formed by first stamping strip material stock into two parallel strips with partly conjoined portions 21 and 22 shown in FIG. 2B such that said parallel strips 21 and 22 are revolved with respect to the centerline spacing of the connector contact to form the mating section which is the typical conventional fabricating method of generally recognized conventional connector contacts. In contrast, the contact of this invention is the result of novel design efforts and is an innovative contact structure which exhibits the desired physical features for optimum performance, and is manufactured using novel and unique techniques which distinctly distinguish over the generally recognized method.

FIG. 3 illustrates an exploded perspective view of this invention with connector contact socket designated generally by the numeral 31 and the insulator housing designated by numeral 32. As shown, each contact socket includes a terminating section 34 that connects the contact to the carrier strip 34', a barbed retention section 35 that retains the contact in the housing 32 and a mating section 36. The terminal-receiving passages 33 of FIG. 3 of the insulator housing 32 and the contact sockets 31 are all in a half-pitch pattern so that only a one step inserting procedure is necessary for insertion of each row of contact sockets.

Figure 4A:
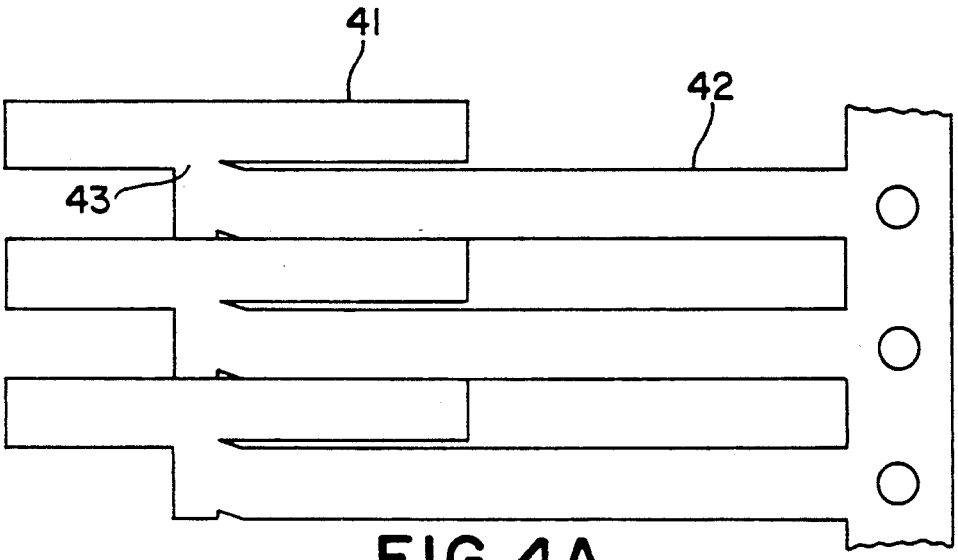
FIGS. 4A, 4B and 4C illustrate some of the separate steps of the socket contact manufacturing method of this invention.
Figure 4B:
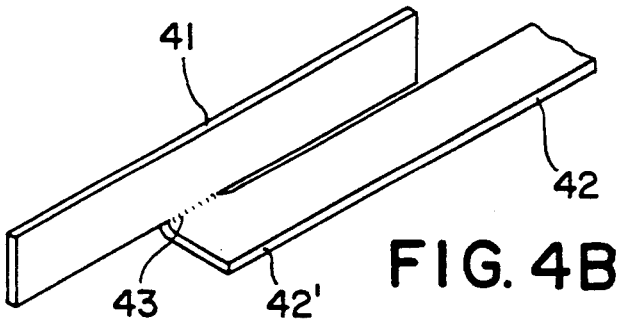
Figure 4C:
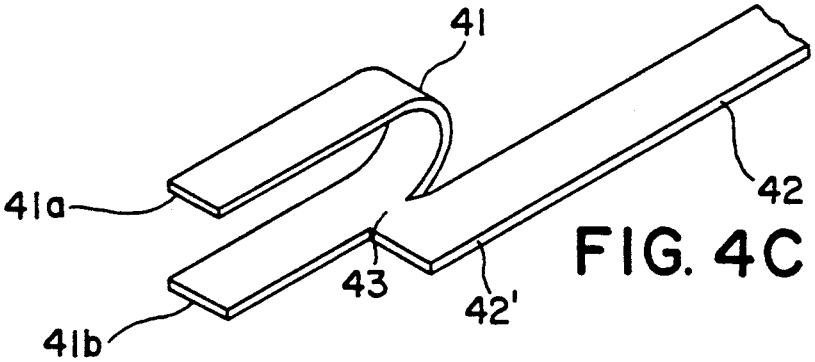

FIG. 4 illustrates the major characteristic steps of the contact socket manufacturing method of this invention from the carrier strip illustrated in FIG. 2C. In accordance with this invention, the contact is stamped and formed by first strip 41 and second strip 42 wherein the first strip 41 and second strip 42 are conjoined through the integral portion 43 as shown in FIGS. 4A, 4B and 4C. The second strip 42 comprises a retention section and a terminating section while the first strip 41 comprises a mating section. One of the distinctions of this invention is that the receiving opening of the mating section is formed in the first strip and is a result of the following two fabricating steps.

Referring to FIG. 4A, strips 41 and 42 are initially in a common plane and conjoined at 43 as shown. Referring to FIG. 4B, the first strip 41 is bent through 90 degrees with respect to the second strip while remaining integrally connected at 43.

As is shown in FIG. 4C, first strip 41 consists of two free ends **41*a* and 41*b*, wherein first free end 41*a* is bent through 180 degrees with respect to the second free end 41*b*** to define a U-shaped portion.

The above mentioned two-step-process is interchangeable. Through this two-step-process, a U-shaped bent portion and a pair of cantilever arms are stamped and formed whereby a connector contact featuring significant material scrap reduction and good electrical connection characteristics is fabricated from the restricted material available, and exhibits a significant breakthrough over the conventional layout.

Figure 5:
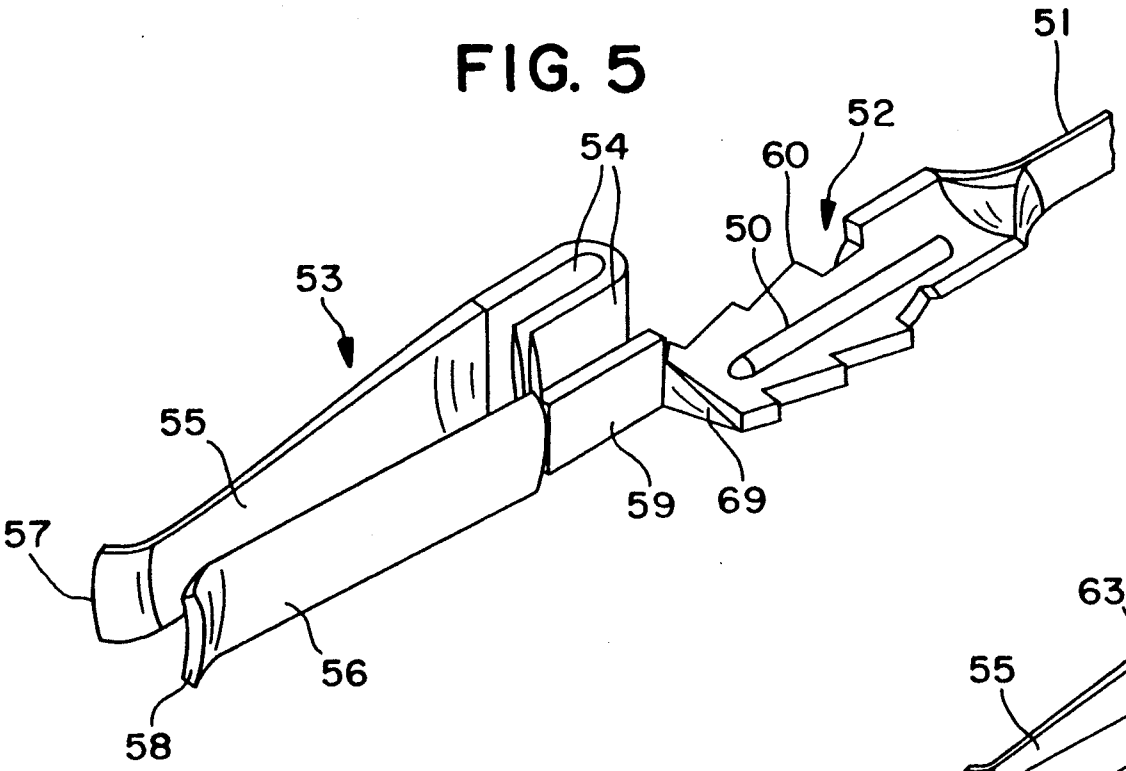
FIG. 5 is a perspective view of a preferred embodiment of the new contact structure of this invention.

In addition to the two steps of the process described above, the contact manufacturing method of this invention includes another step that includes the edge 42' of second strip 42 which is opposite to the conjoined portion 43 being bent toward mating section 41, defining a stop 59 in FIG. 5 to act against U-shaped bent portion such that the contact force of the mating section is well supported and retained to provide a good mechanical and electrical connection relationship.

FIG. 5 illustrates another embodiment of the contact structure of this invention, wherein the socket contact includes a terminating section 51 formed at one end of the contact and adapted to be connected to a PC board or conductor. A mating section designated generally by the numeral 53 is formed at the opposite end of the contact and includes a U-shaped bent portion 54 integral with a pair of cantilever arms 55 and 56. The U-shaped bent portion 54 and cantilever arms are formed from conductive metallic strip stock, cantilever arms facing toward each other as shown in FIG. 5, wherein cantilever arm 55 extends from U-shaped portion 54 converging toward cantilever arm 56 through a predetermined degree while cantilever arm 56 extends from the other end of the U-shaped bent portion 54, firstly extending outwardly or diverging from arm 55 then inwardly or converging toward cantilever arm 55. A pair of divergent receiving ends 57 and 58 extend from the corresponding free ends of cantilever arms 55 and 56 and define a receiving opening for a mating contact. A retention section designated generally by the numeral 52 is formed integrally between the terminating section 51 and mating section 53 to secure the contact inside the insulator housing. A stop 59 acting against the U-shaped bent portion 54 of the mating section 53 limits the displacement of cantilever arms 55 and 56 to ensure a good mechanical and electrical connection feature when mating with another connector. Stop 59 and the retention section 52 are joined integrally by a conjoined portion 69 which is formed by a revolved strip portion to strengthen the contact structure. The retention section 52 also includes barbs 60 for engaging the insulator and a rib 50 to strengthen and rigidify the flat portion.

Figure 6:
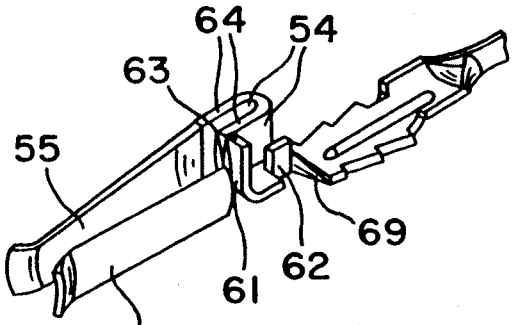
FIG. 6 is a perspective view of another embodiment of the new contact structure of this invention.

FIG. 6 illustrates another embodiment of the contact structure of this invention which is distinguished from the embodiment of FIG. 5 by two stops 61 and 62 wherein the upper edge 63 of stop 61 is formed as high as the upper edge 64 of U-shaped bent portion 54 to exhibit a better effect on restricting the displacement of cantilever arm 55 and 56.

In accordance with the new contact structure and manufacturing method of this invention, a connector contact featuring characteristics of good electrical and mechanical connection and manufacturing cost-saving may be fabricated which may benefit the connector industry.

It is to be understood that the above described arrangements are simply illustrative of the preferred embodiment of this invention. Other arrangements may be devised by those skilled in the art which will embody principles of the invention and fall within the spirit and scope of the claims appended hereto.

What is claimed is:

1. A manufacturing method for producing a novel connector contact structure (31), said connector contact structure (31) including a terminating section (34), a retention section (52), and a mating section (36)(53), all integral and formed by first (41) and second (42) strips adjacent to each other and integral along a bending line (43) with said mating section (36)(53) formed by the first strip (41) and said retention section (52) and terminating section (34) formed by the second strip (42);

said manufacturing method being characterized in that the mating section (36)(53) is formed with a contact opening for making contact with a main contact of another connector, said mating section (36)(53) being stamped and formed from said first strip (41) by the combination of the following forming operations:

said first strip (41) being provided with a first free end (41*a*) and a second free end (41*b*) with said first free end (41*a*) being bent through about 180 degrees toward said second free end (41*b*); and said first strip (41) being bent through about 90 degrees with respect to the second strip (42) along a bending line (43) disposed between said integral first (41) and second (42) strips whereby a U-shaped portion (54) and a pair of cantilever arms (55,56) are stamped and formed to thereby effect a significant material saving and produce an effective contact from a limited amount of material.

2. The manufacturing method for a novel connector contact structure as recited in claim 1, wherein the edge (42') of the second strip (42), which is opposite to the adjacent portion of the first strip (41), is bent toward the said adjacent portion of the first strip (41) to form a stop (59), said stop serving to abut the U-shaped portion (54) of the mating section (53), whereby said mating section (36)(53) may maintain adequate mechanical contact force to ensure an effective electrical connecting relationship.

3. The manufacturing method for a novel connector contact structure as recited in claim 1, wherein said mating section (36)(53) formed by said first strip (41) provides a receiving opening to receive the male contact of a mating connector wherein the centerline of the said receiving opening approximately coincides with the centerline of the second (42) strip.

4. A connector contact structure comprising:

a terminating section (51) formed at one end of the contact structure (31), said terminating section (51) being adapted to connect to a PC board or conductor;

a mating section (36)(53) formed at the other end of the contact structure, said mating section (36)(53) including a U-shaped bending section (54) having spaced leg oprtions and a pair of cantilever arms (55,56) extending integrally from and constituting longitudinal extensions of said spaced leg portions facing each other and a pair of divergent receiving ends (57,58) extending outwardly therefrom to define a receiving opening, said U-shaped bending section opening in the same direction as said receiving opening;

a retention section (52) formed integrally between the terminating section (51) and said mating section (36)(53), said retention section (52) being adapted to retain the contact inside an insulator body (32); and a stop (59) adapted to act against one of said leg portions of said U-shaped bending section to restrict the displacement of the associated cantilever arm to ensure adequate contact pressure with a mating connector.

5. The connector contact structure as recited in claim 4, wherein said stop and retention section conjoin at an integral section formed in a curved shape to rigidify the contact structure.

6. The connector contact structure as recited in claim 4, wherein the height 63) of said stop (61) is the same as the associated leg portion (54) of said U-shaped section to prevent said cantilever arm resisted thereby from being twisted.

7. The connector contact structure as recited in claim 4, wherein said cantilever arms of the mating section are each formed with a curved cross-sectional shape whereby to ensure an adequate electrical contact and stiffness of the cantilever arms whereby resilient displacement of said cantilever arms is effected through said U-shaped bending section.

8. The connector contact structure as recited in claim 7, wherein said pair of cantilever arms of the mating section includes a first cantilever arm extending inwardly from the end of one of said leg portions of the U-shaped bending section and faces the second cantilever arm and said second cantilever arm extends from the end of the other leg portion of the U-shaped bending section in a direction away from the first cantilever arm for a predetermined distance before converging toward the first cantilever arm.

9. A connector contact structure for mounting in an insulator body and formed form integrally joined first and second metallic strips, comprising:

a mating section formed at one end of the contact structure from said first metallic strip and including a pair of cantilever arms facing each other;

a terminating section formed at the other end of the contact structure form said second metallic strip and being adapted to connect to a PC board or conductor; and a retention section formed integrally with said terminating section from said second metallic strip and adapted to retain the contact structure within an insulator body;

said pair of cantilever arms formed by bending said first strip intermediate its ends through 180 degrees to form a two-leg U-shaped resilient portion integrally joining said cantilever arms, said first and second metallic strips being integrally conjoined adjacent said U-shaped resilient portion.

10. The connector contact structure as recited in claim 9, wherein said first strip is bent through about 90 degrees with respect to the second strip along the integral portion therebetween.

11. The connector contact structure as recited in claim 10, wherein said pair of cantilever arms of the mating section includes a first cantilever arm and a second cantilever arm, said first cantilever arm extending from one leg of the U-shaped portion and converging toward the second cantilever arm through a predetermined degree, said second cantilever arm extending from the other leg of the U-shaped portion, first diverging from the first cantilever arm and then converging toward the first cantilever arm.

12. The connector contact structure as recited in claim 11, wherein the retention section includes barbs for engaging the insulator body and a rib for rigidifying the retention section.

13. The connector contact structure as recited in claim 10, wherein a stop flange is provided adapted to act against one leg of said U-shaped resilient portion to restrict the displacement of the cantilever arms.

14. The connector contact structure as recited in claim 13, wherein said stop flange and retention section conjoin at an integral section formed in a curved shape to rigidify the contact structure.

15. The connector contact structure as recited in claim 14, wherein the height of said stop flange is the same as the U-shaped portion to prevent said cantilever arm resisted thereby from being twisted.

* * * * *